US009597547B1

(12) United States Patent
Goldberg

(10) Patent No.: US 9,597,547 B1
(45) Date of Patent: Mar. 21, 2017

(54) FINGER/HAND EXERCISER

(71) Applicant: Elliott Goldberg, Scarsdale, NY (US)

(72) Inventor: Elliott Goldberg, Scarsdale, NY (US)

( * ) Notice: Subject to any disclaimer, the term of this patent is extended or adjusted under 35 U.S.C. 154(b) by 0 days.

(21) Appl. No.: 14/668,011

(22) Filed: Mar. 25, 2015

Related U.S. Application Data

(63) Continuation-in-part of application No. 14/518,448, filed on Oct. 20, 2014.

(51) Int. Cl.
*A63B 23/16* (2006.01)

(52) U.S. Cl.
CPC ..... *A63B 23/16* (2013.01)

(58) Field of Classification Search
CPC . A63B 23/16; A63B 21/1449; A63B 21/1438; A63B 23/14; A63B 2071/0655; A63B 23/00
USPC ..... 482/47
See application file for complete search history.

(56) References Cited

U.S. PATENT DOCUMENTS 1,136,481 A * 4/1915 Ostrovsky ..... G09B 15/06 482/47
1,796,216 A 3/1931 Pettersson
2,118,684 A * 5/1938 Prescott ..... A63B 23/16 482/13
2,947,211 A 8/1960 Shuman
3,447,415 A * 6/1969 Kime ..... G09B 15/06 267/177
3,738,651 A 6/1973 Norman et al.
3,847,051 A 11/1974 Miller
3,937,116 A 2/1976 Ramirez
4,350,335 A * 9/1982 Pasbrig ..... A63B 23/16 482/128
4,678,181 A * 7/1987 Ditsch ..... A63B 23/16 482/128
D294,614 S 3/1988 Ditsch et al.
D325,411 S 4/1992 Everly
5,147,256 A 9/1992 Silagy
D352,754 S 11/1994 Silagy
D359,779 S 6/1995 Peters et al.
5,431,611 A 7/1995 Silagy
5,613,923 A * 3/1997 Anliker ..... A63B 21/0004 482/44
5,690,585 A * 11/1997 Ditsch ..... A63B 23/16 482/121
D405,134 S 2/1999 Hug
D416,299 S 11/1999 Hug
D418,180 S 12/1999 Hug
D418,560 S 1/2000 Hug
D419,210 S 1/2000 Hug
7,967,732 B2 6/2011 D'Addario et al.
2003/0131710 A1 7/2003 Goldiner
2005/0273027 A1 * 12/2005 Farrell ..... A63B 23/16 602/21

(Continued)

*Primary Examiner* — Andrew S Lo
(74) *Attorney, Agent, or Firm* — Weiner & Burt, P.C.; Irving M. Weiner; Pamela S. Burt

(57) ABSTRACT

A hand and finger exerciser apparatus having a base unit structure, resiliently-biased slidable finger button devices, a movable thumb button device rotatably connected to the base unit structure, and a mechanism for selectively locking and unlocking the finger button devices. Each finger button device can be used independently to exercise fingers, or compress the entire unit for complete hand and forearm strengthening.

20 Claims, 10 Drawing Sheets

(56) References Cited

U.S. PATENT DOCUMENTS

| | | | | |
|---|---|---|---|---|
| 2006/0090630 | A1* | 5/2006 | Woods | A63B 21/023 84/465 |
| 2006/0178247 | A1* | 8/2006 | Liu | A63B 21/0004 482/44 |
| 2006/0247102 | A1* | 11/2006 | Kupferman | A63B 21/0004 482/44 |
| 2009/0318269 | A1* | 12/2009 | D'Addario | A63B 21/023 482/47 |
| 2012/0065027 | A1* | 3/2012 | Zachary | A63B 21/0004 482/48 |
| 2013/0196825 | A1 | 8/2013 | Silagy et al. | |

* cited by examiner

FINGER/HAND EXERCISER

RELATED APPLICATION

The present application is a continuation-in-part of and claims priority from U.S. patent application Ser. No. 14/518,448 filed Oct. 20, 2014.

BACKGROUND OF THE INVENTION

The present invention relates generally to improvements for a hand and finger and thumb exerciser apparatus of the type in which engaged elements or components are pressed against the resistance or urgence of resilient members, wherein the user is given the option of exercising selected individual fingers, the thumb, or the entire hand.

More particularly, the present invention relates a hand and finger and thumb exerciser apparatus as described hereinabove, wherein the apparatus includes components for selectively locking and unlocking one or more finger button devices and/or a thumb button device.

Routines contemplating the exercising of fingers against the resistance of springs are embodied in the construction and operational mode of prior art hand exercising devices, as exemplified by the hand exercising device illustrated and described in U.S. Pat. No. 3,738,651 issued to Donald Norman on Jun. 12, 1973 for "Finger, Hand And Forearm Developer".

It is a desideratum of the present invention to avoid the animadversions of conventional finger/hand exercisers, and to provide an apparatus which can be used to independently exercise fingers or compress the entire apparatus for complete hand and forearm strengthening.

SUMMARY OF THE INVENTION

The present invention provides a hand and finger exerciser apparatus, comprising: abase unit structure; a plurality of movable finger button devices; first means for slidably connecting said plurality of finger button devices to said base unit structure; second means for selectively locking and unlocking an associated finger button devices; said second means being operably connected to said base unit structure and to said first means; said first means and said second means being configured to permit selective locking and unlocking of an associated finger button device upon pressing associated second means; and third means, operatively connected to said base unit structure, said movable finger button devices and said first means, for providing resistance to moving of the finger button in a first direction from a first position and for urging the finger button to move in a second direction back to said first position; and a movable thumb button device rotatably connected to said base unit structure.

It is an object of the present invention to provide an improved apparatus as described above, wherein said movable thumb button device attaches to said base unit structure in a plurality of positions and rotates and reticulates.

Another object is to provide such an apparatus which includes fourth means, operatively connected to said movable thumb button device, for providing resistance to moving of said thumb button device in a first direction from a first position of said thumb button device, and for urging said thumb button device to move in a second direction back to said first position of said thumb button device.

Another object is to provide such an apparatus according allows for both left and right thumb usage.

A further object is to provide such an apparatus wherein said thumb button device rotates in all planes.

Another object is provide such an apparatus includes a device to releasably lock the movable thumb button device in an attachment position to the base unit structure.

It is an object of the present invention to provide an improved apparatus as described hereinabove, wherein each finger button device can be used independently to exercise fingers, or to compress the entire unit for complete hand and forearm strengthening.

Another object is to provide an apparatus as described hereinabove, wherein each said movable finger button device includes therewithin said third means having a first predetermined resistance.

Another object is to provide an apparatus as described hereinabove, wherein said third means includes a device selected from a group consisting of a spring device, a magnetic device, a resilient device, and a circumferential pressure device.

Another object is to provide an apparatus as described hereinabove, wherein the exercising use of the apparatus provides the user with the option of individual finger exercise routines, or an entire hand exercising routine.

Another object is to provide an apparatus as described hereinabove, wherein the second means for selectively locking and unlocking the finger button device are diametrically-opposed on opposite sides of the finger button device.

Another object is to provide an apparatus as described hereinabove, wherein: the second means for selectively locking and unlocking the resiliently-biased finger button device are diametrically-opposed on opposite sides of the finger button device; and said second means moves relative to said body unit structure perpendicular to a major elongated central axis of the finger button device to selectively and releasably lock or unlock the finger button device.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

Figure 1:
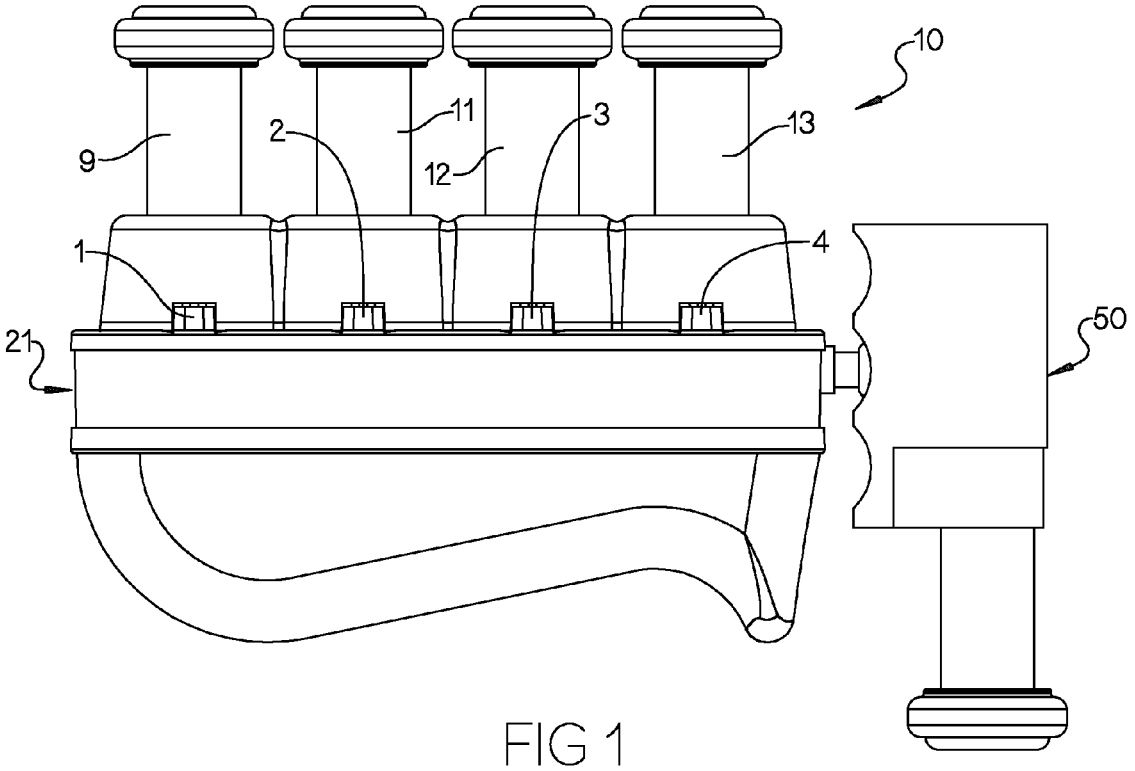
FIG. 1 is a front elevation of a first embodiment of the invention.

In the various embodiments, the same reference numbers apply to similar components.

With reference to the drawings, there is shown in FIGS. 1-17 a first embodiment of the hand and finger exerciser apparatus 10.

The apparatus 10 includes a base unit structure 21.

The apparatus 10 further includes a plurality of resiliently-biased finger button devices 9, 11, 12 and 13, and a resiliently-biased thumb button device 50.

The resilience and resistance of the devices 9, 11, 12, 13 and 50 can be from a spring 25, 26, 27, 28 or 51, respectively, or other resistance devices.

The apparatus 10 also includes first means for slidably connecting the plurality of finger button devices 9, 11, 12 and 13 to the base unit structure 21.

The apparatus 10 further includes second means 1, 2, 3, 4, 5, 6, 7 and 8 for selectively locking and unlocking the plurality of finger button devices 9, 11, 12 and 13.

The second means 1, 2, 3, 4, 5, 6, 7 and 8 are operably connected to the base unit structure 21 and to the first means.

The second means can be located on one side of the apparatus 10, on both sides thereof, and can be a toggle, slide or other mechanism.

The first means and the second means 1, 2, 3, 4, 5, 6, 7 and 8 are configured to permit selective locking and unlocking of an associated finger button device 9, 11, 12 and 13, respectively, upon pressing or moving the second means.

The apparatus 10 also includes third means, operatively connected to the base unit structure 21, the movable finger button devices 9, 11, 12 and 13, and the first means, for providing resistance to moving of the finger button device in a first direction from a first position of the finger button. and for urging the finger button device to move in a second direction back to the first position of the finger button device.

The apparatus 10 also includes fourth means, operatively connected to the movable thumb button 50, for providing resistance to moving of thumb button device 50 in a first direction from a first position of thumb button device 50, and for urging the thumb button device 50 to move in a second direction back to the first position of the thumb button device 50.

The base unit structure 21 of the optional individual finger, thumb, and/or entire hand exerciser apparatus 10 is comprised of an operative arrangement of three cooperating body members, namely an upper body member 22, a middle or centrally disposed body member 23, and a lower body member 24.

The four adjacent individually independently-slidable finger button devices 9, 11, 12 and 13 are slidably positioned in the base unit structure 21.

Each one of the four adjacent individually-independently slidable finger button devices 9, 11, 12 and 13 is provided with an enlarged upper portion 20.

The finger button devices 9, 11, 12 and 13 and the thumb button device 50 are provided with completely-enclosed springs 25, 26, 27, 28, and 51, respectively, or other types of suitable resilient resistance members.

Figure 3:
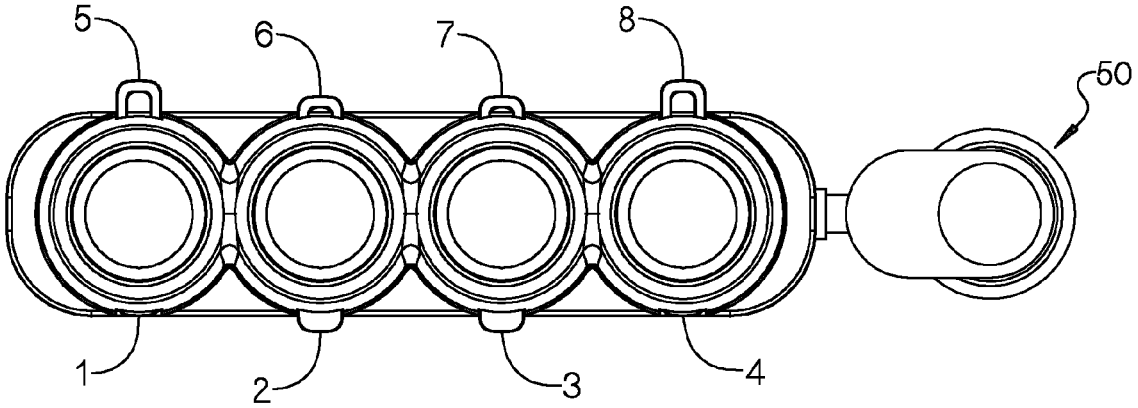
FIG. 3 is a view similar to FIG. 2 but with two finger button devices locked.

The locked position of finger button devices 9 and 13 is illustrated in FIG. 3.

Figure 2:
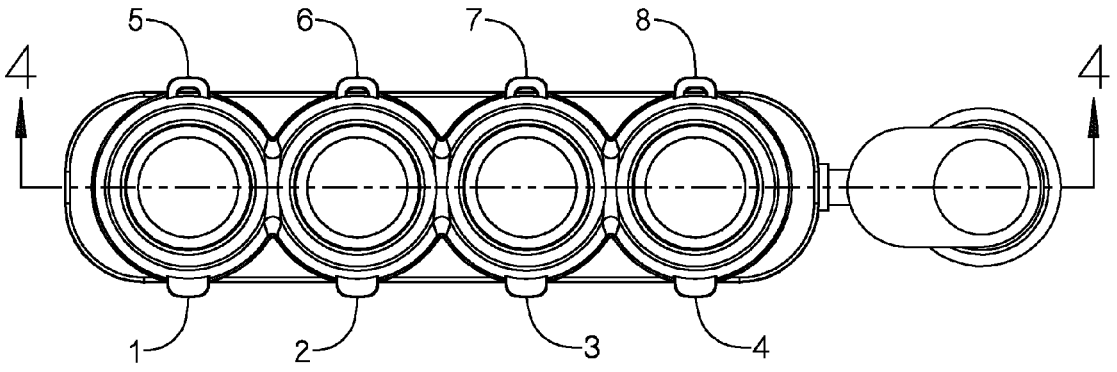
FIG. 2 is a top plan view of the FIG. 1 apparatus.
Figure 4:
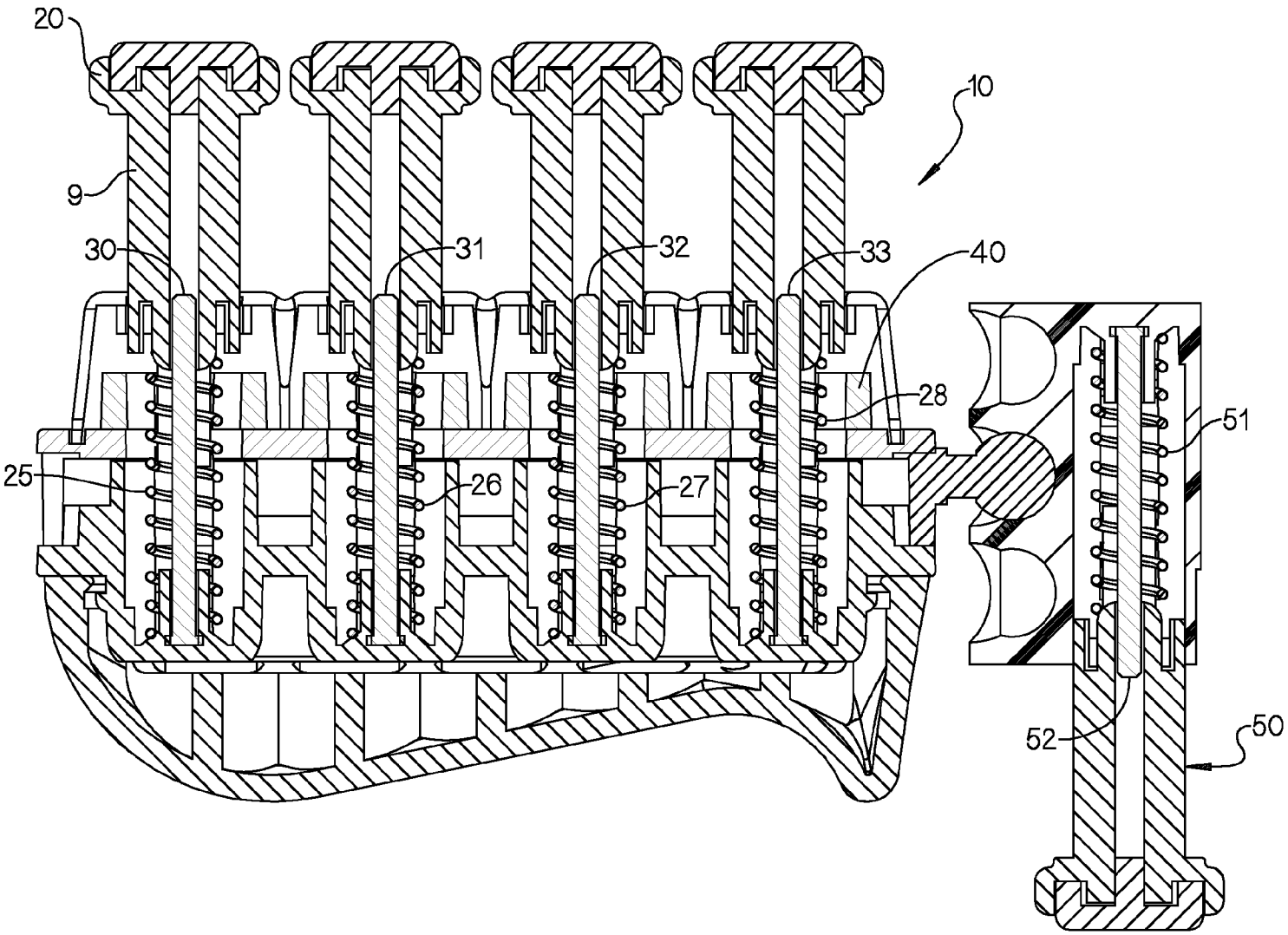
FIG. 4 is a sectional view taken along line 4-4 of FIG. 2.
Figure 5:
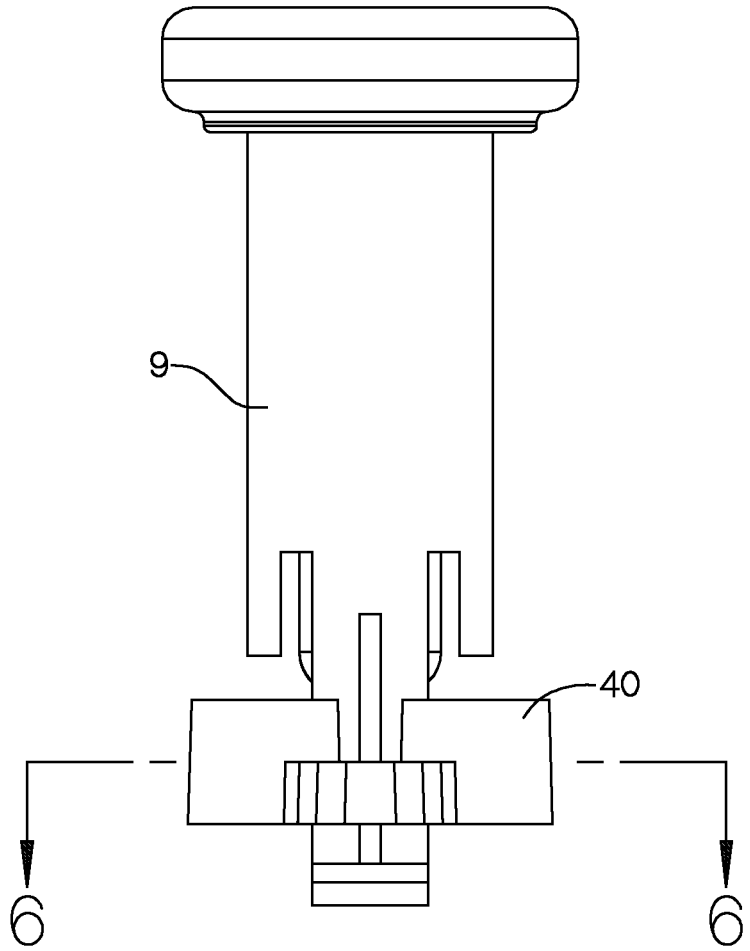
FIG. 5 is a view of a finger button device and cooperating parts.

In the unlocked position (as illustrated in FIGS. 1, 2 and 4), each one of the finger button device 9, 11, 12 and 13 extends a predetermined distance above the upper surface 29 of the upper body member 22.

As illustrated in FIG. 4, guide pins 30, 31, 32, 33 and 52 are arranged to be located axially within a cooperating one of the helical springs 25, 26, 27, 28 and 51, respectively, disposed in encircling relation about its associated guide pin.

Each finger button device 9, 11, 12 and 14 is provided with individual, diametrically-opposed, finger locking/unlocking members 1/5, 2/6, 3/7 and 4/8, respectively, which members form part of an associated slidable component 40 shown in FIGS. 4-11.

FIGS. 1, 2, 4, and 12-17 illustrate the arrangement of the components when the independently-slidable spring-biased button devices 9, 11, 12, 13 and 50 are in position ready to be used for exercising.

The second means 1, 2, 3, 4, 5, 6, 7 and 8 for selectively locking and unlocking the finger button devices 9, 11, 12 and 13 are disposed diametrically-opposed on opposite sides of their associated finger button device.

The second means can be located on one side of the apparatus 10, on both sides thereof, and can be a toggle, slide, or other mechanism The second means 1, 2, 3, 4, 5, 6, 7 and 8 moves relative to the body unit structure 21 perpendicular to a major elongated central axis of the finger button device to selectively and releaseably lock or unlock the finger button device.

Figure 6:
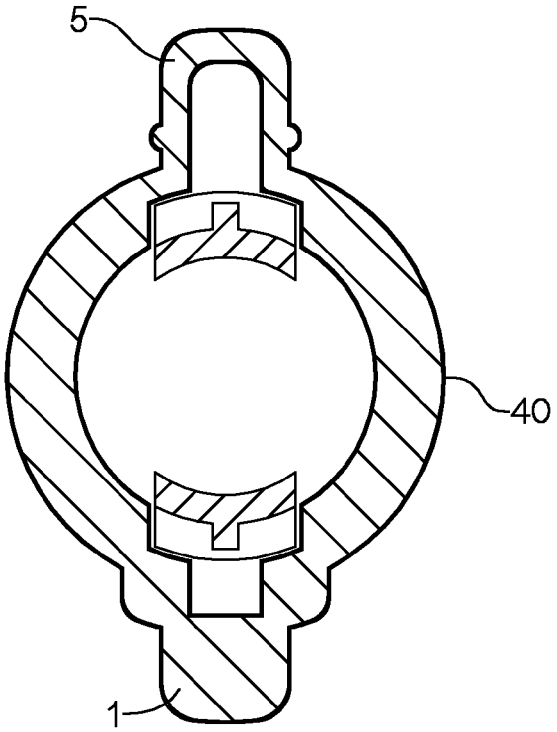
FIG. 6 is a sectional view taken along the line 6-6 of FIG. 5 showing the unlocked position.

FIG. 6 illustrates the unlocked position of the components.

Figure 7:
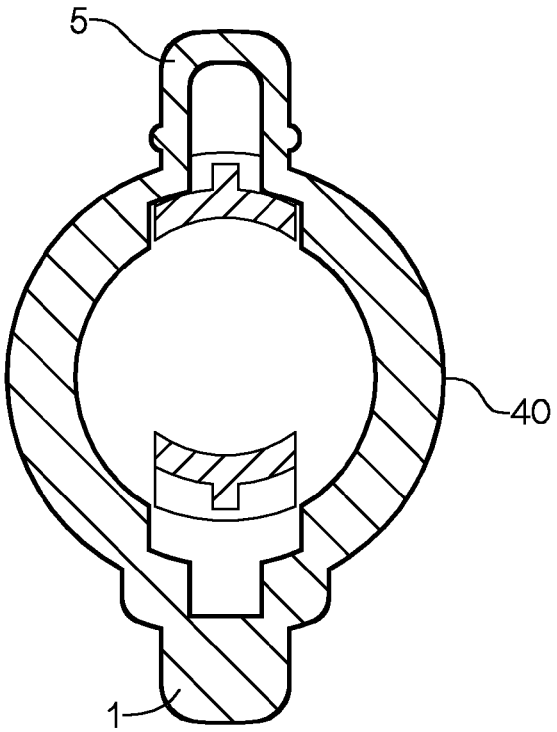
FIG. 7 is a view similar to FIG. 6 but showing the locked position.
Figure 8:
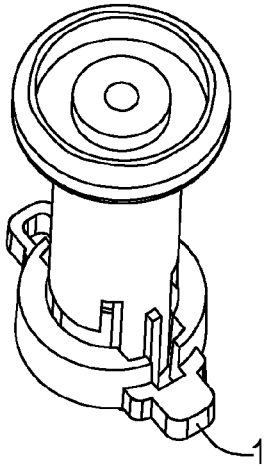
FIGS. 8-11 show perspective view of the parts depicted in FIGS. 6 and 7.
Figure 9:
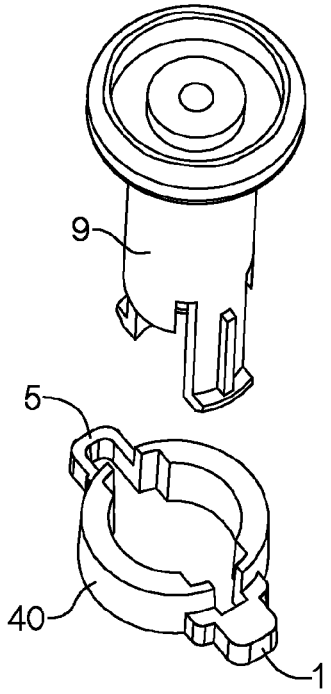
Figure 10:
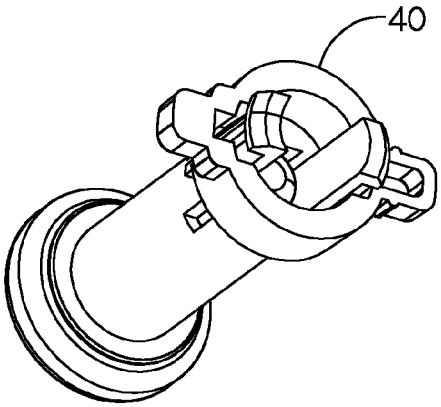
Figure 11:
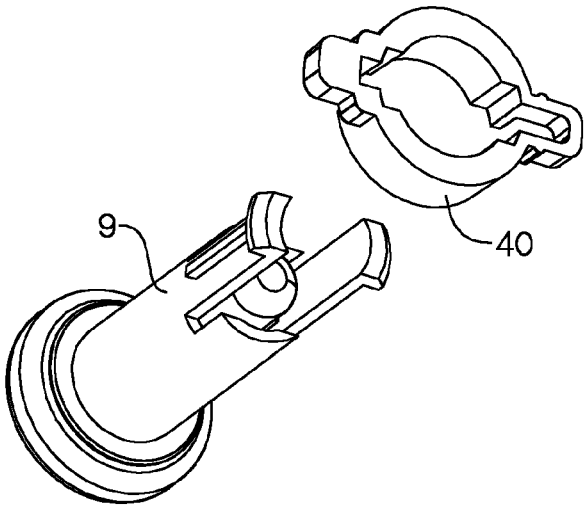

FIG. 7 illustrates the locked position of the components.

FIGS. 8-11 illustrate the components in perspective views to show how the components are assembled for locking and unlocking movement relative to one another.

FIGS. 8-11 show perspective view of the parts depicted in FIGS. 6 and 7.

Figure 12:
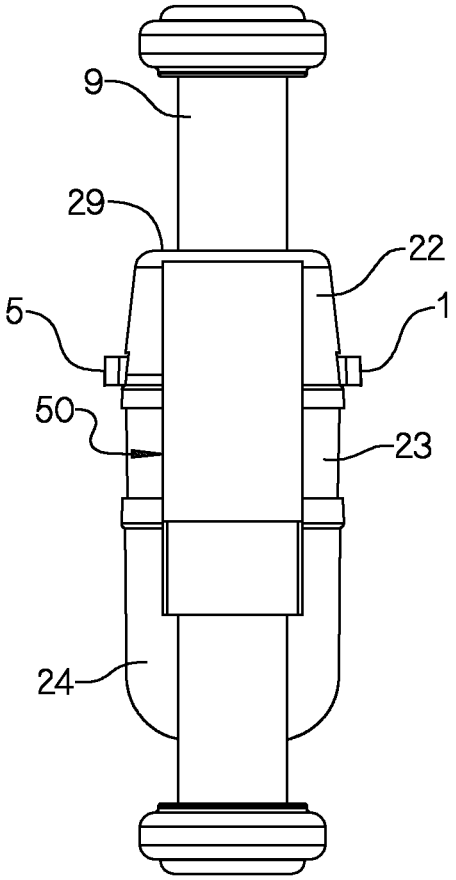
FIG. 12 shows a side view of the FIG. 1 apparatus.

FIG. 12 shows a side view of the FIG. 1 apparatus.

The thumb button device 50 is removably attachable to the base unit structure 21 via a ball/socket arrangement shown in FIG. 4.

Figure 13:
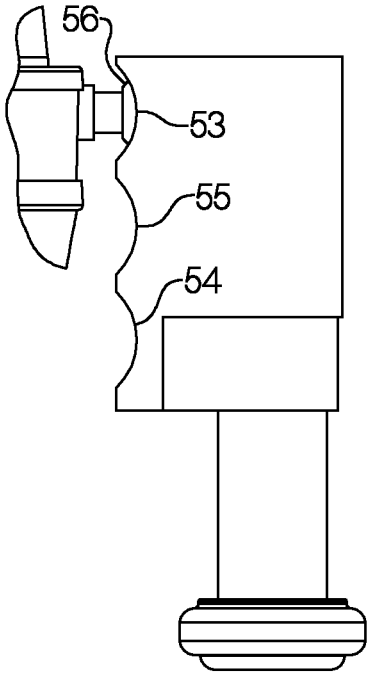
FIG. 13 shows the thumb button device attached to the base unit structure in a first of three attachments positions.

FIG. 13 shows the thumb button device 50 attached to the base unit structure 21 (via a ball component 56 shown in FIG. 4) in a first position 53 of three attachment socket/positions 53, 54 and 55.

Figure 14:
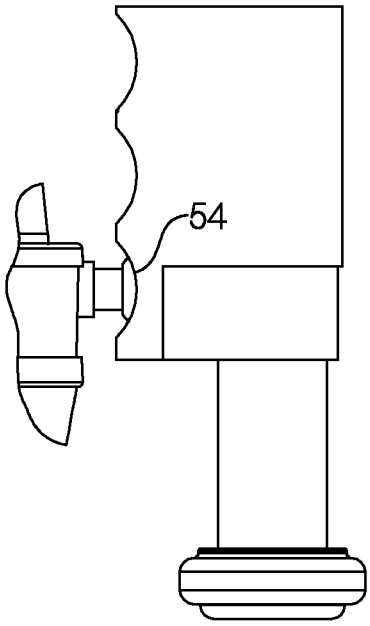
FIG. 14 shows the thumb button device attached to the base unit structure in a second of three attachments positions.

FIG. 14 shows the thumb button device 50 attached to the base unit structure 21 in a second position 54 of the three attachment socket positions.

Figure 15:
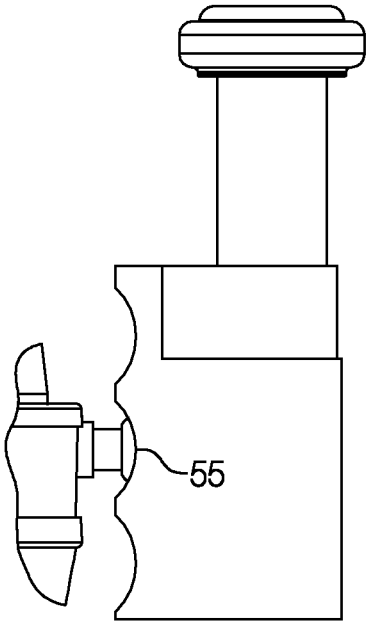
FIG. 15 shows the thumb button device attached to the base unit structure in a middle position of three attachments positions and facing upwardly.

FIG. 15 shows the thumb button device 50 attached to the base unit structure in a middle position 55 of the three attachment/socket positions and facing upwardly.

Figure 16:
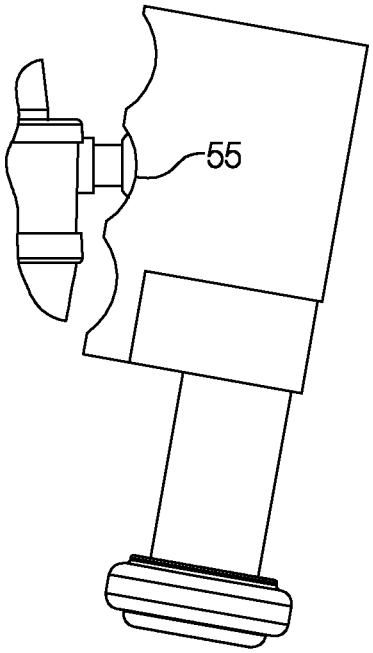
FIGS. 16 and 17 show rotational variations of the thumb button device as attached in FIG. 15.
Figure 17:
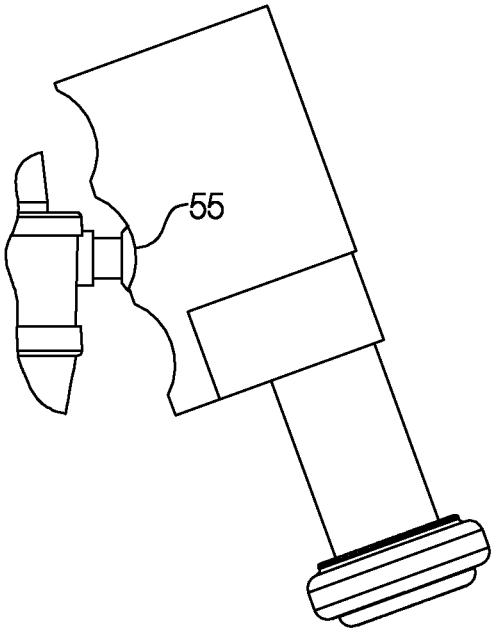

FIGS. 16 and 17 show rotational variations of the thumb button device 50 as attached in FIG. 15.

Figure 18:
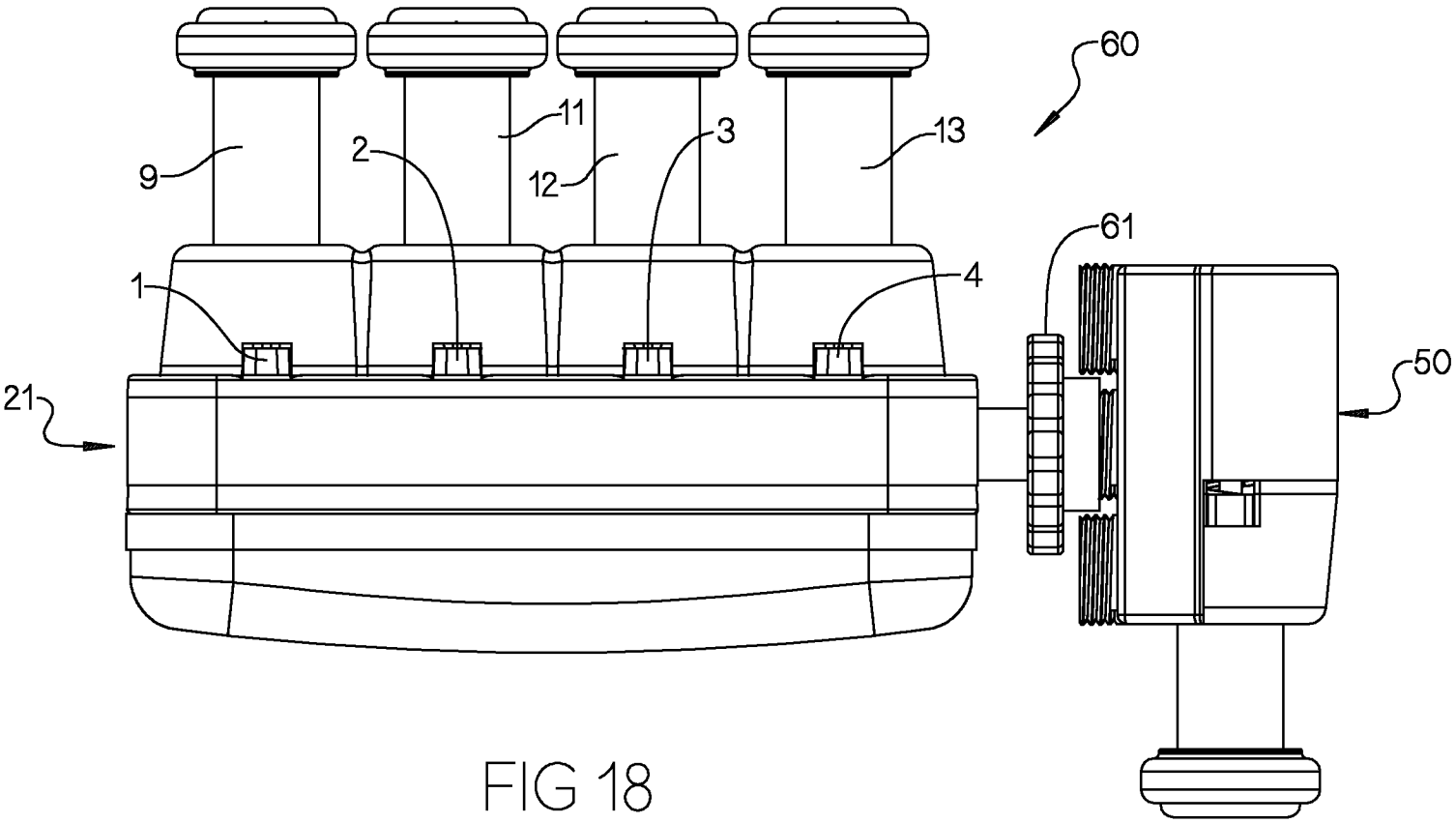
FIG. 18 shows a second embodiment of the invention including a device to releasably lock the thumb button device in its attachment position to the base unit structure.

FIG. 18 shows a second embodiment apparatus 60 of the invention including a device 61 to releasably lock the thumb button device 50 in its attachment position to the base unit structure 21.

Figure 19:
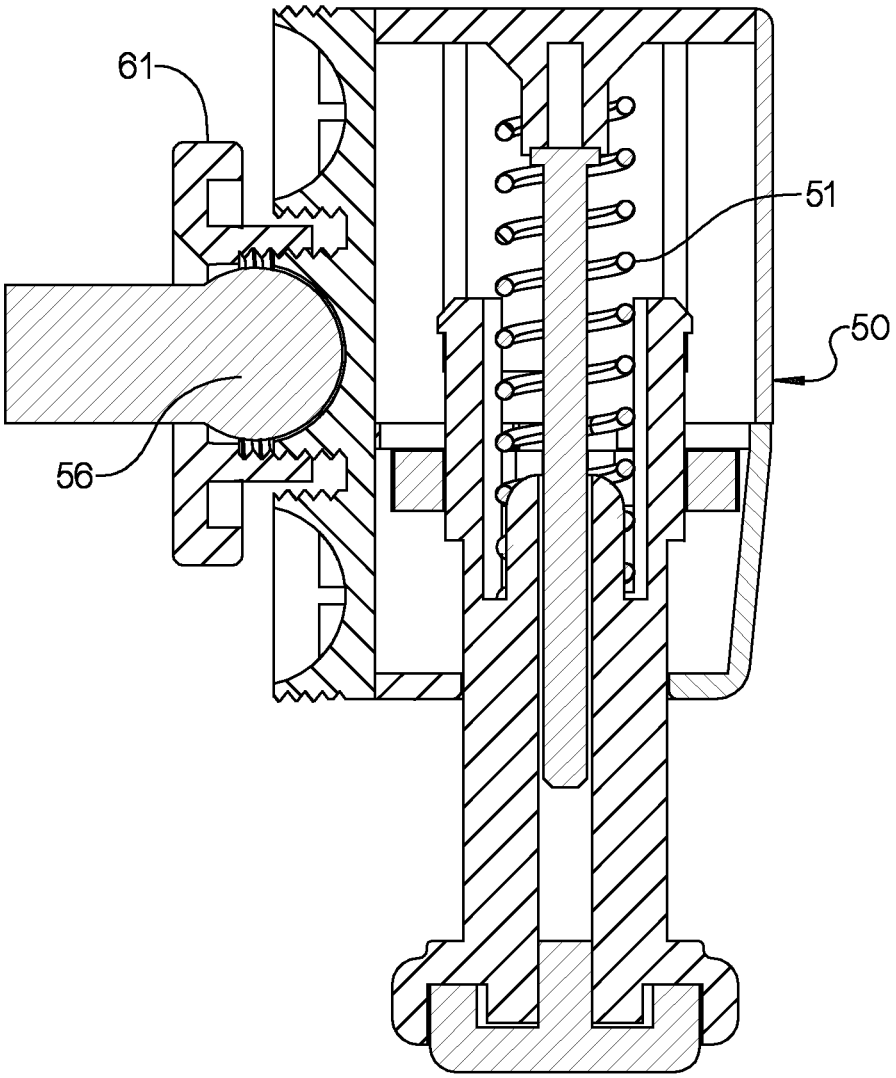
FIG. 19 shows an enlarged sectional drawing of a portion of the FIG. 18 embodiment.

FIG. 19 shows an enlarged sectional drawing of a portion of the FIG. 18 embodiment.

The apparatus 10 and 60 are used to develop isolated finger strength, flexibility and coordination as it builds hand and forearm strength.

Each finger button device 9, 11, 12 and 13 can individually be locked and unlocked.

Each button device 9, 11, 12, 13 and 50 has a single spring 25, 26, 27, 28 and 51, respectively, which is covered by an associated plastic sheath.

The resilience and resistance of the devices 9, 11, 12, 13 and 50 can be from a spring 25, 26, 27 or 28, respectively, or other devices.

Each finger button device 9, 11, 12, 13 and 50 can be used independently to exercise fingers, thumb, or compress the entire unit for complete hand and forearm strengthening.

The exercising use of the apparatus 10 and 60 provides the user with the option of individual finger and/or thumb exercise routines, or an entire hand exercising routine.

In the exercise of one or more individual fingers, but less than all of the fingers of the entire hand, a selected finger button device, such as finger button device 9 of FIG. 1, is depressed against the resistance of its cooperating spring 25, thus resulting in finger button device 9 being urged from an initial starting clearance position as illustrated in FIG. 1, to a position against the upper surface 29 of the upper body member 22.

During individual finger exercising using one or more fingers to depress the selected finger button devices 9, 11, 12 and/or 13 against its cooperating exercising spring of the set of four thereof, the thumb of the user may be passive or active.

However, when the exerciser apparatus 10 or 60 is used for an entire hand exercise routine, the thumb of the user is active or passive, along with the four fingers.

In such an entire hand exercise routine, the thumb contacts the lower surface 34 of the lower body member 24.

While the finger and hand exerciser herein shown and disclosed in detail is fully capable of attaining the objects and providing the advantages hereinbefore stated, it is to be understood that it is merely illustrative of the presently preferred embodiments of the invention and that no limitations are intended to the detail of construction or design herein shown other than as defined in the appended claims.

The description of the invention set forth hereinabove, together with the accompanying drawings, should not be construed as limiting the invention to the examples shown and described, because those skilled in the art to which this invention appertains may be able to devise other forms thereof within the ambit of the appended claims.

The invention claimed is:

1. A hand and finger exerciser apparatus, comprising:

a base unit structure;

a plurality of movable finger button devices;

first means for slidably connecting said plurality of finger button devices to said base unit structure;

second means operably connected to said base unit structure and to said first means;

said second means including a plurality of slidable components wherein each slidable component is operatively connected to an associated finger button device;

each slidable component has a first position permitting its associated finger button device to slide within said first means, and a second position preventing its associated finger button device from sliding within said first means;

each slidable component having a first protuberance exposed externally of said first means enabling an user to push said first protuberance moving the slidable component into said first position to selectively permit its associated finger button device to slide within said first means, and having a second protuberance exposed externally of said first means enabling the user to push said second protuberance moving the slidable component into said second position to selectively prevent its associated finger button device from sliding within said first means;

said finger button devices and said slidable components being configured so that when the slidable component is in said first position its associated finger button device can slide within said first means, and when the slidable component is in said second position said second position its associated finger button device is prevented from sliding within said first means;

third means, operatively connected to said base unit structure, said movable finger button devices and said first means, for providing resistance to moving of the finger button devices in a first direction from a first finger button device position, and for urging the finger button devices to move in a second direction back to said first finger button device position; and a movable thumb button device rotatably connected to said base unit structure.

2. A hand and finger exerciser apparatus according to claim 1, wherein:

each said movable finger button device includes therewithin said third means having a first predetermined resistance.

3. A hand and finger exerciser apparatus according to claim 1, wherein:

said third means includes a device selected from a group consisting of a spring device, a magnetic device, a resilient device, and a circumferential pressure device.

4. A hand and finger exerciser apparatus according to claim 2, wherein:

said third means includes a device selected from a group consisting of a spring device, a magnetic device, a resilient device, and a circumferential pressure device.

5. A hand and finger exerciser apparatus according to claim 1, wherein:

said first and second protuberances are diametrically-opposed on opposite sides of the finger button device.

6. A hand and finger exerciser apparatus according to claim 4, wherein:

said first and second protuberances are diametrically-opposed on opposite sides of the finger button device.

7. A hand and finger exerciser apparatus according to claim 1, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

8. A hand and finger exerciser apparatus according to claim 2, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

9. A hand and finger exerciser apparatus according to claim 3, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

10. A hand and finger exerciser apparatus according to claim 4, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

11. A hand and finger exerciser apparatus according to claim 5, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

12. A hand and finger exerciser apparatus according to claim 6, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

13. A hand and finger exerciser apparatus according to claim 1, wherein:

said movable thumb button device is configured to attach to said base unit structure in one of a plurality of positions and rotates and reticulates.

14. A hand and finger exerciser apparatus according to claim 1, including:

fourth means, operatively connected to said movable thumb button device, for providing resistance to moving of said thumb button device in a first direction from a first position of said thumb button device, and for urging said thumb button device to move in a second direction back to said first position of said thumb button device.

15. A hand and finger exerciser apparatus according to claim 13, including:

fourth means, operatively connected to said movable thumb button device, for providing resistance to moving of said thumb button device in a first direction from a first position of said thumb button device, and for urging said thumb button device to move in a second direction back to said first position of said thumb button device.

16. A hand and finger exerciser apparatus according to claim 1, wherein:

said apparatus allows for both left and right thumb usage.

17. A hand and finger exerciser apparatus according to claim 13, wherein:

said apparatus allows for both left and right thumb usage.

18. A hand and finger exerciser apparatus according to claim 1, wherein:

said thumb button device rotates in all planes.

19. A hand and finger exerciser apparatus according to claim 1, including:

a device to releasably lock said movable thumb button device in an attachment position to said base unit structure.

20. A hand and finger exerciser apparatus according to claim 14, including:

a device to releasably lock said movable thumb button device in an attachment position to said base unit structure.

* * * * *